United States Patent [19]

Larson

[11] Patent Number: 4,831,851

[45] Date of Patent: May 23, 1989

[54] COMBINATION/ELECTRONIC LOCK SYSTEM

[75] Inventor: Wayne F. Larson, Salem, Oreg.

[73] Assignee: Supra Products, Inc., Salem, Oreg.

[21] Appl. No.: 946,806

[22] Filed: Dec. 29, 1986

Related U.S. Application Data

[63] Continuation-in-part of Ser. No. 850,285, Apr. 10, 1986, abandoned.

[51] Int. Cl.[4] ..... E05B 37/08

[52] U.S. Cl. ..... 70/303 A; 70/316; 70/321; 70/333 R; 70/277

[58] Field of Search ..... 70/302, 303 A, 303 R, 70/316, 321, 322, 333 R, 279, 277

[56] References Cited

U.S. PATENT DOCUMENTS

| | | | |
|---|---|---|---|
| 323,918 | 8/1885 | Crockett et al. | 70/277 |
| 430,764 | 6/1890 | Beers et al. | 70/279 X |
| 504,462 | 9/1893 | Tinkham | 70/277 |
| 550,655 | 12/1895 | Stone | 70/303 A X |
| 655,006 | 7/1900 | Pratt | 70/149 |
| 767,757 | 8/1904 | Jacobson et al. | 70/279 X |
| 2,053,901 | 9/1936 | Findlay | 70/333 R X |
| 2,079,702 | 5/1937 | Diesel | 70/303 A |
| 3,968,667 | 7/1976 | Gartner et al. | 70/333 R X |
| 3,991,596 | 11/1976 | Gartner | 70/322 X |
| 4,257,249 | 3/1981 | Johns-Hunt | 70/303 A |
| 4,359,883 | 11/1982 | Bechtiger et al. | 70/303 A X |
| 4,578,967 | 4/1986 | Yu | 70/462 X |
| 4,665,727 | 5/1987 | Uyeda | 70/279 |
| 4,669,394 | 6/1987 | Fogleman et al. | 109/59 T |
| 4,671,086 | 6/1987 | Fogleman et al. | 70/277 |
| 4,686,912 | 8/1987 | Fogleman et al. | 109/59 T |
| 4,745,784 | 5/1988 | Gartner | 70/277 |

FOREIGN PATENT DOCUMENTS

| | | | |
|---|---|---|---|
| 644382 | 7/1962 | Canada | 70/302 |
| 1014875 | 8/1957 | Fed. Rep. of Germany | 70/322 |
| 1018335 | 10/1957 | Fed. Rep. of Germany | 70/322 |
| 815654 | 7/1959 | United Kingdom | 70/303 A |

*Primary Examiner*—Robert L. Wolfe
*Assistant Examiner*—Suzanne L. Dino
*Attorney, Agent, or Firm*—Klarquist, Sparkman, Campbell, Leigh & Whinston

[57] ABSTRACT

A lock mechanism having a mechanical combination lock and an electronic lock, wherein the mechanical combination lock serves for effecting a fail safe entry in case of failure of the electronic lock. More specifically, the lock mechanism includes a mechanical combination lock having a bolt-retracting linkage which is tripped by inward movement of a dial into a first operative relationship with a driver on the drive spindle. An electronic latch prevents bolt retraction by this bolt-retracting linkage when in the first operative positive until the electronic latch has been operated. However, when the tumblers of the lock have been aligned and a gate bar enters the tumblers, the bolt-retraction linkage is caused to assume a second operative relationship with the driver so as to permit bolt retraction despite the latching effect of the electronic lock.

15 Claims, 3 Drawing Sheets

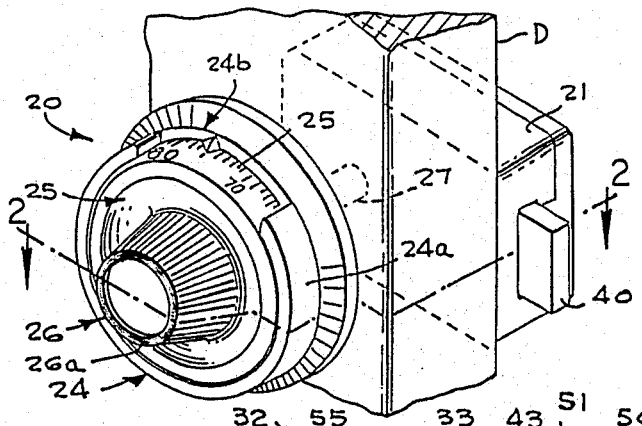
FIG. 1
PRIOR ART
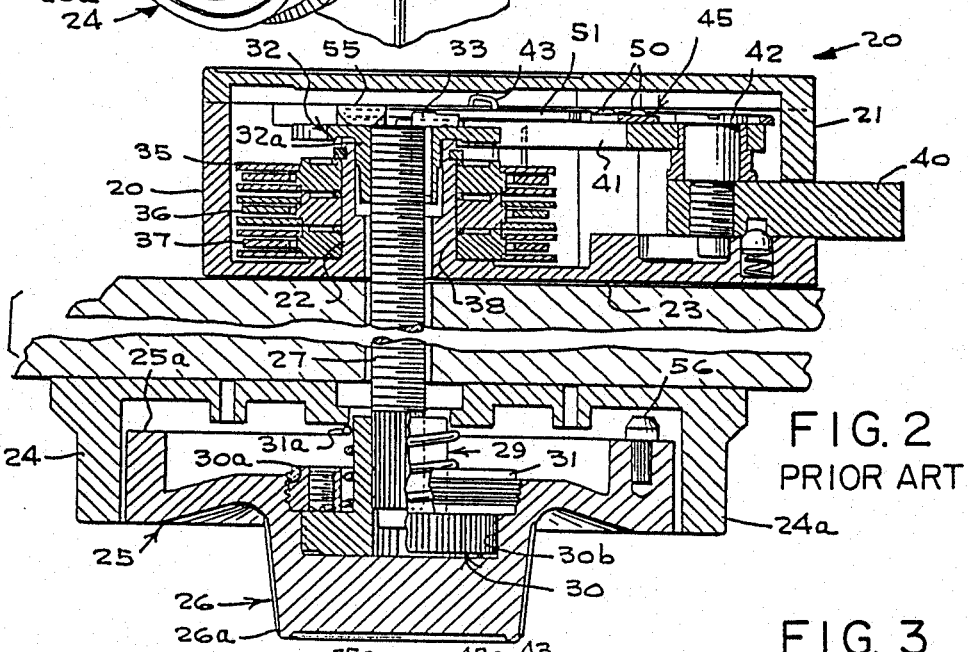
FIG. 2
PRIOR ART
FIG. 3
PRIOR ART
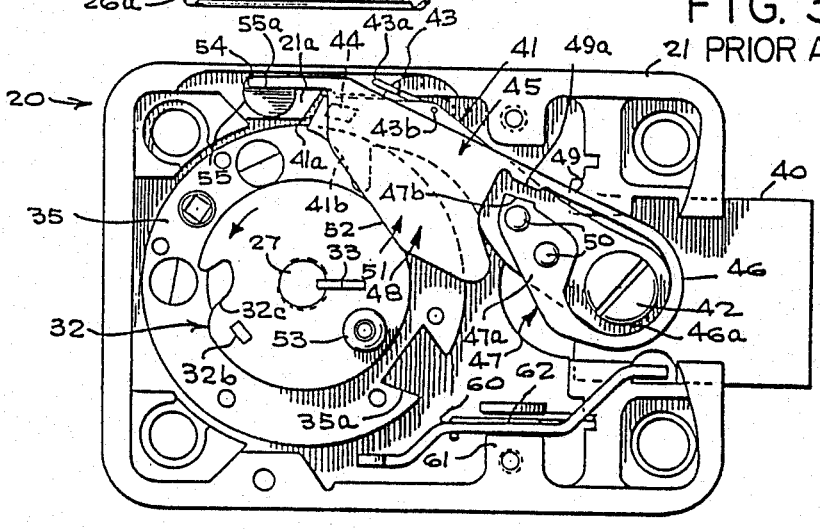

FIG. 8
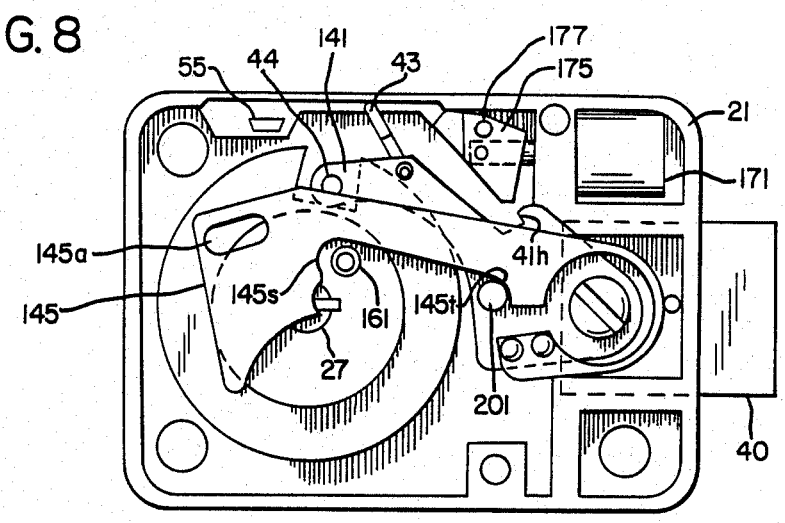
FIG. 9
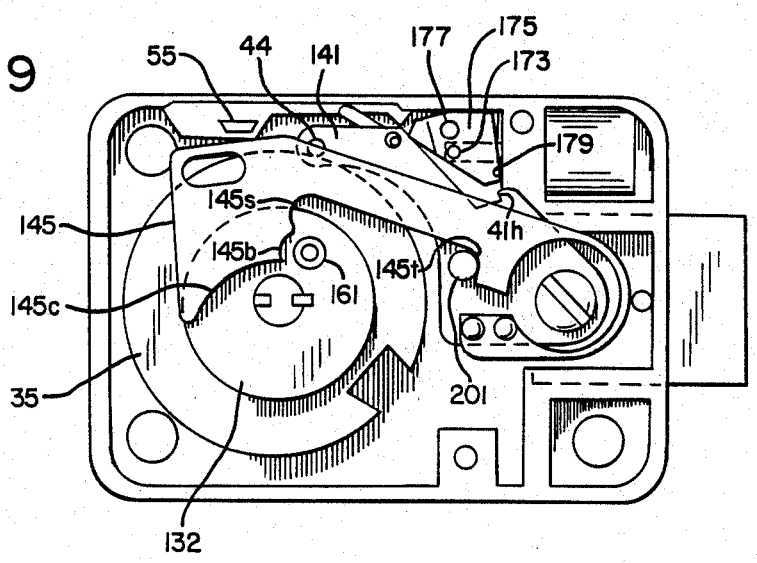
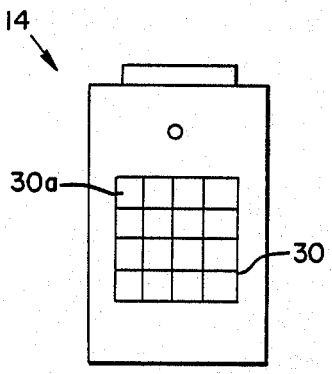
FIG. 10
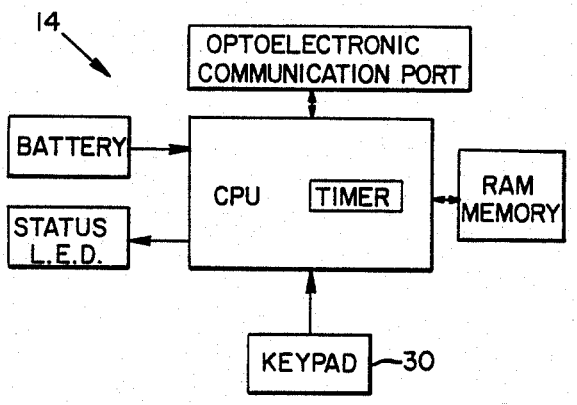
FIG. 11

COMBINATION/ELECTRONIC LOCK SYSTEM

RELATED APPLICATION

This application is a continuation-in-part of my copending application Ser. No. 850,285 filed Apr. 10, 1986 and entitled Combination/Electronic Lock and now abandoned.

TECHNICAL FIELD

The present invention relates to improvements in a combination lock and more particularly to improvements in a combination lock of the type in common usage on small safes.

BACKGROUND OF THE INVENTION

It has been proposed to use an electronic lock instead of a mechanical combination lock on secure enclosures such as safes and filing cabinets. However, a serious problem exists if the electronic lock fails in that there is no way to open the enclosure until the electronics have been repaired. If the failed electronic components are located within the locked enclosure, the only recourse is to torch the enclosure open.

In the copending application of myself and Walter Henderson entitled "Electronic Real Estate Lockbox System," Ser. No. 831,601, filed Feb. 21, 1986, and in my copending application entitled "Electronic Door Lock and Key," Ser. No. 814,364, filed Dec. 30, 1985, electronic lock systems are disclosed having a number of advantages that would be useful in connection with a lock for an enclosure such as a safe. For instance, the systems of the copending applications include a number of unique electronic keys. The systems are such that whenever a key is used, the identity of each key is recorded, together with its date and time of access, in an electronic memory so that a log can be kept of the keys used to gain access to the lock.

My present invention comprises modifying a more or less standard small safe lock, such as that disclosed in U.S. Pat. No. 3,968,667 to Gartner, issued July 13, 1976, so that it can additionally be unlocked by an electronic system, such as is disclosed in the above referenced copending applications.

More specifically, the preferred embodiment of my invention contemplates the provision of a socket or nest on the dial ring of a safe's combination lock, the socket being designed to receive an electronic key. I have modified the combination lock in such a manner as to make use of some of the lock's existing mechanical parts, but have modified these parts so as to enable the lock to be opened by use of a number of differently coded electronic keys. I have so designed the interrelationship of the electronics and the mechanics to provide a fail safe arrangement, so that in the event of a failure in the electronic lock circuitry, the safe can nevertheless be opened by entering the mechanical combination in the normal fashion.

I contemplate that only one person, probably an official of a firm, have knowledge of the safe's mechanical combination. Thus, no one can open the lock via the mechanical combination except that selected person. However, the employees who have reason to gain access to the safe can do so by making use of their individual electronic keys, each of which accesses is recorded in the lock's electronic access log.

Various other objects of the invention will be apparent from the following description taken in connection with the accompanying drawings wherein:

FIG. 1 is a perspective view of the combination lock shown in U.S. Pat. No. 3,968,667.

FIG. 2 is a horizontal section view taken along line 2—2 of FIG. 1.

FIG. 3 is a rear elevation view of the lock of FIG. 1 with the rear cover removed and showing the lock in its locked condition.

FIG. 8 is a view similar to FIG. 4 but showing the parts in a different condition of operation.

FIG. 9 is another view similar to FIG. 4 but showing a still, different condition of operation.

FIG. 10 shows an electronic key suitable for use with the present invention.

FIG. 11 is a schematic block diagram of the key of FIG. 10.

DETAILED DESCRIPTION OF PREFERRED EMBODIMENT

Figure 4:
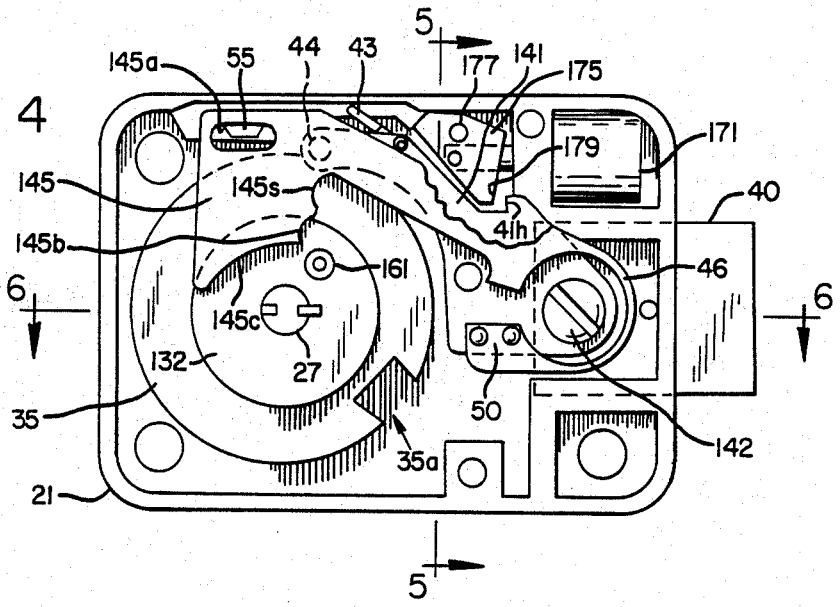
FIG. 4 is a view like FIG. 3 but showing the lock after having been modified in accordance with the concepts of the present invention.
Figure 7:
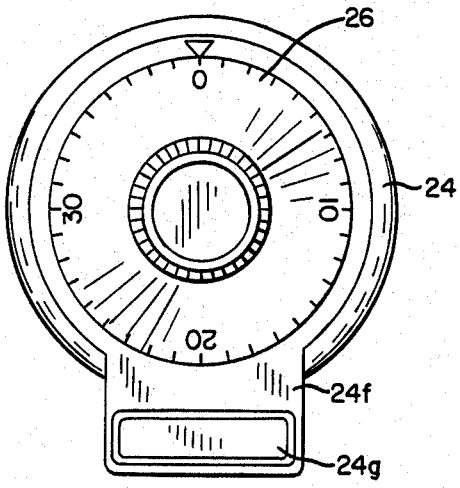
FIG. 7 is a front view of my lock as mounted on the door of a safe.
Figure 5:
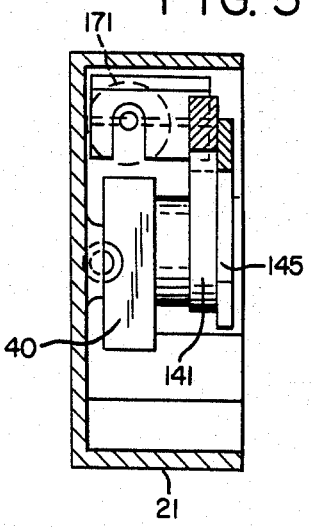
FIG. 5 is a horizontal section taken along lines 5—5 of FIG. 4.

The disclosures of U.S. Pat. No. 3,968,667 and of applications Ser. Nos. 831,601 and 814,364, filed Feb. 21, 1986, and Dec. 30, 1985, respectively, are incorporated herein by reference.

Reference is first made to FIG. 1 which shows the lock disclosed in U.S. Pat. No. 3,968,667. This lock is mounted on a safe door, which I have labeled D. The lock includes a lock case 21 which is mounted on the rear of the door, while the dial and knob 26 and the associated dial ring 24 are mounted on the front of the door. A spindle 27 projects from dial and knob 26 into the lock mechanism in case 21.

Referring to FIGS. 2 and 3, spindle 27 carries a wheel or disc 32, called a "driving cam", which includes drive cam gate **32*c*. Drive cam gate 32*c* is disposed in a drive position with respect to a drive nose 41*b* coupled to a locking bolt 40 anytime the dial is disposed in its zero position. However, a drive relationship to bolt 40 is not established merely because gate 32*c*** is in its drive position. Two further conditions must be met.

First, the combination needs to be dialed into the lock to align the gates of the tumbler wheels 35–37 (a gate **35*a* is shown in FIG. 3) with a fence bar 44 on a fence lever 41 (mounted at its opposite end on the bolt 40). Second, fence lever 41 must be moved downwardly to dispose fence bar 44 within the tumbler gates so as to cause a fence lever nose 41*b* to drop into the drive cam gate 32*c*. Briefly stated, this is accomplished in U.S. Pat. No. 3,968,667 by moving the dial axially inwardly, while at its zero position, so as to trip a lever actuator member 45 from its resting position on a shoulder formation 55 in the case 21. Lever actuator member 45 causes fence lever 41 to move downwardly by virtue of their coupling through a U-shaped spring 46 so that a driving relationship is created between drive cam gate 32*c* and fence lever nose 41*b***.

After the above described engagement between fence lever nose **41*b* and drive cam gate 32*c* is effected, rotation of dial 26 and shaft 27 in a counterclockwise direction causes fence lever 41 to retract bolt 40 to the left, as these parts are shown in FIG. 2**.

A reset system is provided to return lever actuator member 45 to its elevated, inactive position after operation of the lock is completed. This system includes a rearwardly projecting roller 53 on driving cam 32 which displaces an inclined cam surface 52 of actuator member 45 as cam 32 is rotated clockwise (as illustrated in FIG. 3). When actuator member 45 has been elevated sufficiently, outwardly projecting latch finger 54 on actuator member 45 engages an upwardly facing latch surface 55*a* of shoulder formation 55, causing actuator member 45 to be supported thereby.

Referring now to FIGS. 4–9, there is shown the lock of the present invention. A drive spindle 27 extends from dial 26 to the lock mechanism within case 21. A dial ring 24, surrounding dial 26, includes a depending lower portion 24*f* containing a nest or socket 24*g* having means, such as an optoelectronic or an electromagnetic communications port, for communicating with an electronic key. A suitable electronic key is detailed in the above mentioned copending application and is shown in FIGS. 10 and 11.

One of the changes I have made in the Gartner lock is that I have redesigned lever actuator member 145 so that it functions as a driver for bolt 40, instead of using fence lever 41 (FIG. 3) for this purpose.

Lever actuator member 145 is similar to the lever actuator 45 in the cited Gartner patent in that it is mounted at 50 on the inner end of fence lever 141 and in that it includes a resilient or spring portion 46. Lever actuator member 145 has an opening 145*a* to receive a latch shoulder 55 projecting from case 21. Both fence lever 141 and lever actuator member 145 are pivotally mounted to bolt 40 by a common pivot 142.

To make lever actuator member 145 serve as a driver for bolt 40, I have provided two driving recesses 145*b* and 145*s* on the right-hand edge of the free end portion of this member. One of these driving recesses is to be engaged by a dual purpose roller 161 when said roller is moved in a counterclockwise direction (as illustrated in FIG. 4) by a driving cam or driver 132. Such rotation causes roller 161 to urge lever actuator member 145 to the left and consequently causes the lever actuator member to withdraw spring loaded bolt 40 from its normally extended position. However, with the parts as shown in FIG. 4, roller 161, if carried around by driving cam 132, would simply ride under a reset recess 145*c* of the lever actuator member since this member is in its elevated reset position, resting on shoulder 55.

It is evident that until such time as lever actuator member 145 is dislodged from its elevated, reset position on latch shoulder 55, it cannot have the desired effect of engaging with roller 161 to permit retraction of bolt 40. Dislodging actuator member 145 from shoulder 55 i effected by turning dial 2 to its zero position and pushing it axially inward. The axial inward movement of shaft 27 causes the rear face of driving cam 132, which is connected to spindle 27, to push against lever actuator member 145 and displace it rearwardly so that it trips off shoulder 55 to its upper operative position, shown in FIG. 9. This action alone, however, will have no effect on the lock bolt 40 because the bolt cannot move until certain other operations have occurred, as discussed below.

ELECTRONIC OPERATION

As a further modification to the Gartner lock, I have provided a solenoid latch to enable or disable movement of bolt 40. The solenoid latch includes a solenoid 171 pivotally connected at 173 to a latch 175, as shown in FIGS. 4, 8 and 9. Latch 175 is pivotally mounted at 177 to the case. The plunger of solenoid 171 is spring loaded so that it extends out from the solenoid when the solenoid is deenergized.

In FIG. 4, solenoid 171 is deenergized and its plunger is extended, thereby causing an operative, or stop end 179 of latch 175 to be in a latching position with respect to a hook 41*h* provided on fence lever 141. In this latching position, hook 41*h* cannot move laterally past stop end 179 of latch 175 even if roller 161 is engaged with recess 145*b*. Consequently, bolt 40 is prevented from retracting. To open the lock in this configuration, an electronic key 14, such as is illustrated in FIGS. 10 and 11, must be used.

Whenever it is desired to operate the lock electronically, electronic key 14 is enabled by entering an electronic password via a pad 30 on the front of the key. The key is then inserted into the socket or nest 24*g* on dial ring 24 and the "ON" button 30*a* pressed so as to send a signal to the lock. If the proper password is entered into the key through pad 30, an exchange of signals between the key and lock commences. After an exchange of proper signals, solenoid 171 energizes for a predetermined period and retracts the solenoid plunger. This causes stop member 179 of latch 175 to pivot and raise slightly to its FIG. 9 position so that hook 41*h* just clears stop end 179 of the latch. In such configuration, counterclockwise rotation of shaft 27 drives lever actuator member 145 to the left, thereby retracting bolt 40. Electronic unlocking of the combination electrical/mechanical lock is thus accomplished without the need to enter the mechanical combination.

As is disclosed in greater detail in the copending applications, a variety of restrictions may be placed on operation of the electronic lock by appropriate programming of the lock and key microprocessors. For example, electronic operation can be restricted to certain hours of the day or to certain ones of the authorized key owners.

The electronic lock circuitry and associated power pack (such as a battery) are enclosed in a housing and are mounted in a convenient place, as for example, on the inside of the safe door.

FAIL SAFE OPERATION

Figure 6:
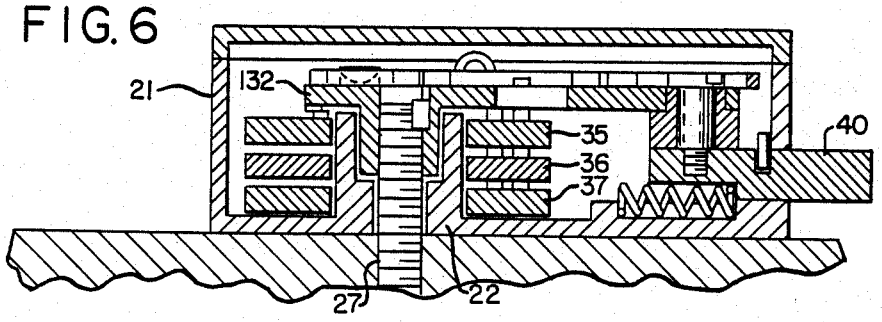
FIG. 6 is a vertical section taken along lines 6—6 of FIG 4.

The lock of the present invention is adapted to be opened by entry of a mechanical combination even if the above described electronic lock circuitry should fail. In this regard, there is provided a series of tumblers 35, 36 and 37 rotatably mounted about spindle 27 and turnably mounted on a hub or hollow boss 22 of case 21, as is illustrated in FIG. 6. These tumblers in their construction and mode of operation are identical to those in the Gartner patent.

When the proper combination is dialed into the lock mechanism, the gates of tumblers 35-37 are brought into alignment below a fence bar 44, carried by fence lever 141. Normally, fence lever 141 is held in an out of the way position by an overcenter spring 43, as shown in the Gartner patent.

In my modification of the Gartner lock, the lever actuator member 145 has two operative positions, a lower operative position shown in FIG. 8 and the upper operative position discussed earlier and shown in FIG. 9. Lever actuator member 145 moves in tandem with fence lever 141 due to their coupling at points 50 through spring 46. In FIG. 9, note that fence bar 44 of fence lever 141 simply rests on the peripheries of the tumblers 35, etc., since it is assumed that the gates of the tumblers have not yet been brought into alignment with the fence bar.

Now, assume that the electronics fail and it is not possible to operate the lock electronically. Furthermore assume that the failure is in the electronic power pack and related circuitry within the safe, rather than in the electronic key. Although the lock electronics are inoperative, the lock nevertheless can be opened by making use of the mechanical combination lock feature of the invention.

When an electronic failure of the lock occurs, latch 175 is returned to its locking (FIG. 4) position by virtue of the spring loading of the plunger of solenoid 171. To open the lock in this circumstance, a person having knowledge of the mechanical combination dials it in, thereby bringing the tumbler wheel gates into alignment with the fence bar 44 (FIG. 8). It is then only necessary to move the dial to its zero position and push it inwardly to dislodge the lever actuator member 145 free of the latch shoulder 55 and down to its lower operative position. Downward movement of lever actuator member 145 causes fence lever 141 also to move downward so that fence bar 44 is positioned within the aligned tumbler gates.

When fence bar 44 of fence lever 141 is positioned within the aligned tumbler gates, as shown in FIG. 8, hook 41*h* is positioned low enough that it does not engage stop end 179 of electronically actuated latch 175, even though latch 175 is in its locking position. Furthermore, when fence bar 44 is positioned within the aligned tumbler gates, dual purpose roller 161 is disposed opposite the second driving recess 145*s*. In this configuration, shaft 27 can be turned counterclockwise to engage roller 161 with recess 145*s*, thereby driving lever actuator member 145 to the left and retracting bolt 40 despite the failure of the electronic circuitry.

As another feature of my lock, a drive pin 201 (FIGS. 8 and 9) is provided on fence lever 141 which, when lever actuator member 145 is disposed in either its first o second operative position, is disposed into a driving relationship with a drive recess 145*t* formed on lever actuator member 145. The fit of recess 145*t* and drive pin 201 is such that the bolt retraction force exerted on bolt 40 is transmitted through the actuator member's engagement with pin 201, rather than through the curved spring portion 46 linking the actuator member and the fence lever.

To reset lever actuator member 145 to its elevated position on shoulder 55, it is only necessary to turn shaft 27 clockwise, so that roller 161 engages the reset edge 145*c* of lever actuator member 145. This raises the free end of member 145 so as to bring the upper edge of said member into engagement with an inclined ramp (not shown) under latch shoulder 55. This inclined ramp deflects the free end of member 145 rearwardly so as to allow opening 145*a* to snap over shoulder 55.

To review the operation of my lock, when lever actuator member 445 is dislodged from its idle position on shoulder 55 to its upper operative position (FIG. 9), it is incapable of retracting bolt 40 unless a proper electronic key is used to energize solenoid 171 (FIG. 9 shows solenoid 171 energized). This is because the position of lever actuator member 145 in its upper operative position is not low enough for hook 41*h* to clear stop end 179 of electronic latch 175 when in its latched (FIG. 8) position. When, however, the mechanical combination has been properly entered, fence bar 44 can fall into the aligned tumbler gates, as shown in FIG. 8. In this lower operative position, lever actuator member 145 can move laterally beneath stop end 179 of latch 175, thereby allowing bolt 40 to retract regardless of the state of the electronic lock.

Having described and illustrated the principles of my invention with reference to a preferred embodiment, it should be apparent to those skilled in the art that the invention can be modified in arrangement and detail without departing from the principles thereof. For example, although the foregoing discussion has proceeded with reference to a rotary dial type combination lock, a lock of the type in which a mechanically coded key is used to align the tumblers could be substituted therefor. Similarly, although the illustrated embodiment has employed distinct lever actuator and fence lever members, the functions of these elements could be combined by providing a fence bar on the lever actuator member and spring biasing this member downwardly. Accordingly, I claim as my invention all modifications as may come within the scope and spirit of the following claims and equivalents thereof.

I claim:

1. A lock mechanism comprising:

a mechanical lock having tumblers and means for moving said tumblers from unaligned positions to a position of alignment;

a locking bolt;

a driver;

means for effecting turning movement of said driver;

linkage means for moving the locking bolt upon turning movement of the driver, said linkage means having an inoperative position and first and second operative positions;

means for moving said linkage means from its inoperative position, said means disposing the linkage means in its first operative position when the tumblers of said lock are unaligned and disposing the linkage means in a second operative position when said tumblers are aligned; and electronic latch means having first and second operative states, the electronic latch means in its first state permitting the linkage means to move the locking bolt only if said linkage means is in its second operative position, the electronic latch means in its second state permitting the linkage means to move the locking bolt when the linkage means is in either its firsts or second operative positions.

2. The lock mechanism of claim 1 in which the mechanical lock is a mechanical combination lock of the type including a dial spindle having the driver on its inner end and a turnable dial on its outer end so that turning movement of the dial effects turning movement of the driver.

3. The lock mechanism of claim 2 in which the dial is mounted for axial shifting movement and in which axial movement of said dial moves said linkage means from its inoperative position to one of its operative positions.

4. A lock mechanism according to claim 1 in which said driver carries a single driving element selectively engageable with said linkage means.

5. A lock mechanism according to claim 1 in which said linkage means includes a fence lever carrying a fence bar for acceptance by said tumbler in their aligned condition, said linkage means further including a lever actuator member having first and second driving relationships with said driver.

6. A lock mechanism according to claim 5 in which the electronic latch means includes a latch element having a latching relationship with said fence lever whenever the fence bar cannot enter the tumblers because of their nonalignment, but having no latching relationship with said fence lever when said latch bar enters the aligned tumblers.

7. A lock mechanism according to claim 5 in which the fence lever is pivotally connected to the bolt and in which the lever actuator member is coupled to the fence lever by a spring member.

8. A lock mechanism according to claim 7 in which a drive pin is provided on the fence lever and in which a corresponding drive recess is provided on the lever actuator member so that a driving engagement is established between the drive recess and the drive pin when the lever actuator member is in a driving relationship with the driver, whereby the bolt retraction force is transmitted through the engagement between the lever actuator member and the drive pin, rather than through the spring member coupling the lever actuator member to the fence lever.

9. A fail safe lock system comprising:

a bolt;

a linkage for moving the bolt to an unlocked position;

locking means normally engaged with the linkage for preventing motion of the bolt to the unlocked position;

first unlocking means for moving the locking means to disengage said locking means from the linkage to thereby allow motion of the bolt to the unlocked position; and second unlocking means for moving the linkage to disengage said linkage from the locking means to thereby allow motion of the bolt to the unlocked position.

10. The invention of claim 9 in which at least one of said first or second unlocking means includes an electronically operable solenoid.

11. The invention of claim 9 in which the second unlocking means includes:

a plurality of tumblers; and means for preventing the linkage from moving to disengage the locking means until said tumblers are in a condition of alignment.

12. The failsafe lock system of claim 9 in which the linkage has a rest position in which it is held in an inoperative position and two nonrest positions distinct from said rest position, and in which the locking means includes electrically movable mechanical stop means for preventing a bolt-retracting movement of the linkage when the linkage is in the first of said non-rest positions, said mechanical stop means being ineffective to prevent a bolt-retracting movement of the linkage when the linkage means is in the second of said non-rests positions.

13. In a mechanical combination lock having components that can assume first and second positions, the components in the first position acting to lock the lock and the components in the second position acting to unlock the lock, the components being positionable in their second position by operating the combination lock to enter an unlocking combination, an improvement comprising:

an electrically movable member; and means permitting the components to assume a third position in which the locked or unlocked state of the lock depends on the position of the electrically movable member.

14. In a lock having lock housing, a retractable bolt, a drive cam having an engagement feature to which a lever member can couple, a knob coupled to the drive cam by a spindle, and a lever member pivotally mounted to the bolt and movable in an arc from a first position to a second position in which it can engage with the engagement feature on the drive cam to thereby couple the bolt to the drive cam, said coupling permitting the bolt to be retracted by rotation of the drive cam by the knob, an improvement comprising:

a member movably mounted in the housing; and a solenoid for holding the movable member in either a first or second position;

said movable member preventing bolt retracting movement of the lever member by movement of the drive cam's engagement feature by rotation of the knob when the solenoid holds the movable member in the first position;

said movable member permitting bolt retracting movement of the lever member by movement of the drive cam's engagement feature by rotation of the knob when the solenoid holds the movable member in the second position.

15. The invention of claim 14 which further comprises a series of tumblers each having gates that can be brought into a condition of alignment by operation of the knob, and in which the drive cam has a second engagement feature with which the lever member can engage to permit bolt retracting movement of the lever member by movement of the drive cam's second engagement feature by rotation of the knob when the solenoid holds the movable member in the first position.

* * * * *